US008006725B2

(12) United States Patent
Majkrzak

(10) Patent No.: US 8,006,725 B2
(45) Date of Patent: Aug. 30, 2011

(54) LOG SPLITTTER

(75) Inventor: David S. Majkrzak, West Fargo, ND (US)

(73) Assignee: Echo, Inc., Lake Zurich, IL (US)

( * ) Notice: Subject to any disclaimer, the term of this patent is extended or adjusted under 35 U.S.C. 154(b) by 92 days.

(21) Appl. No.: 12/321,259

(22) Filed: Jan. 16, 2009

(65) Prior Publication Data

US 2010/0024919 A1 Feb. 4, 2010

Related U.S. Application Data

(60) Provisional application No. 61/137,687, filed on Aug. 1, 2008.

(51) Int. Cl.
*B27L 7/00* (2006.01)
*B27L 7/06* (2006.01)

(52) U.S. Cl. ..... 144/4.6; 144/193.2; 144/195.8; 144/195.1

(58) Field of Classification Search ..... 144/193.1, 144/193.2, 195.1, 195.8, 4.6, 195.7
See application file for complete search history.

(56) References Cited

U.S. PATENT DOCUMENTS

| | | | | |
|---|---|---|---|---|
| 4,112,985 | A | 9/1978 | Gosselin | |
| 4,498,293 | A | 2/1985 | Gregory | |
| 5,284,193 | A * | 2/1994 | Mires et al. | 144/195.1 |
| 5,373,877 | A * | 12/1994 | Chapman | 144/195.1 |
| 5,460,211 | A | 10/1995 | Minati | |
| 5,464,330 | A | 11/1995 | Prince et al. | |
| 5,967,206 | A | 10/1999 | Milton | |
| 7,066,223 | B2 | 6/2006 | Stone | |
| 7,104,295 | B2 | 9/2006 | Heikkinen et al. | |
| 7,371,053 | B2 | 5/2008 | Schmidt | |

* cited by examiner

*Primary Examiner* — Shelley Self
(74) *Attorney, Agent, or Firm* — Wood, Phillips, Katz, Clark & Mortimer

(57) ABSTRACT

A log splitter having a bed for accepting a log. The bed has an operating length between first and second components, with the former a wedge. The log splitter can be placed in: (a) a first operative state wherein the bed has a first operating length; and (b) a second operative state wherein the bed has a second operating length. With the log splitter in the first operative state, the wedge is movable: (a) from a first starting position in a first lengthwise direction to effect splitting of a log; and (b) thereafter, oppositely to the first lengthwise direction back into the first starting position. In the second operative state, the wedge is movable: (a) from a second starting position to effect splitting; and (b) thereafter, back into the second starting position. The log splitter further has an operating assembly to move the first component.

21 Claims, 10 Drawing Sheets

LOG SPLITTTER

CROSS-REFERENCE TO RELATED APPLICATION

This application claims priority to provisional application Ser. No. 61/137,687, filed Aug. 1, 2008, entitled "Log Splitter".

BACKGROUND OF THE INVENTION

1. Field of the Invention

This invention relates to log splitters and, more particularly, to a log splitter with a wedge that is forcibly directed into a length of log to effect splitting thereof.

2. Background Art

A multitude of different log splitter designs has been developed to date. Virtually all of these designs incorporate a wedge that acts upon a length of log. In one such design, the wedge is stationary. A ram drives the log forcibly against the wedge to progressively effect splitting thereof.

In an alternative design, the wedge is forcibly advanced against a log that is stably supported against a backing wall. The interaction of the wedge and log is the same as that for the previously described system design.

The drives for the wedge/ram also vary widely in design. Most commonly, the drives are hydraulically operated. However, virtually any force producing mechanism is functional for this purpose. It is additionally known to design systems that require that the splitting force be manually generated through a user by exploiting mechanical advantage.

The log splitters may be self-contained in terms of their operation. Alternatively, the log splitters are designed to derive power from a separate supply, such as a separate piece of machinery. For example, it is common to hook up log splitters to tractors, and the like, as to the power take-off units thereon.

It is also known to design the system components so that the length of the log is in different orientations. Most commonly, the systems are designed for either vertical or horizontal operation.

In virtually every design, a bed is formed to accept the logs in an operative position for splitting. The bed length determines the overall capacity of the log splitter.

In a typical operation, the ram or wedge will be retracted fully to accept the maximum length of log for which the system is designed. The user then places a length of log in the bed and through an actuator causes the wedge/ram to advance progressively through full stroke to cause the log to be split. Hydraulic systems may be designed to automatically retract after a full stroke movement or in the event that a predetermined resistance to advancement is encountered, which may occur before there is full stroke movement.

While log splitters are designed for a particular maximum log length, in most operations the log lengths will not be matched to this maximum capacity. Further, the lengths are generally random.

Regardless of the length of the log piece being split, the systems in the past have operated in the same manner for each splitting operation. That is, the ram/wedge is fully retracted at start-up and extended either to full stroke or until a predetermined resistance to advancement is encountered. When log lengths significantly shorter than the bed length are to be split, the above types of log splitters operate inefficiently. For example, if a 12 inch long log is placed on a bed with a 24 inch capacity, the first 12 inches of movement of the ram/wedge from its retracted position is essentially wasted. As a result, a large percentage of the time that the system is operating may be unproductive. Over time, this unproductive operating time may take its toll on equipment in terms of parts wear, etc.

Potentially more significant is the fact that the user is required to wait out each lag period between the time that the ram/wedge moves from a retracted position into engagement with a log piece. Aside from the fact that this causes inefficient use of an operator's time, this lag may induce boredom that may result in an operator's being less attentive to an operation that has a significant potential for injury. Added to this is the fatigue factor. In the end, an operator's time is less efficient for a given production than it would be if this lag time were eliminated.

Another problem with some conventional log splitters is that they are often designed so that a power source is operated at a constant level set by the operator throughout a splitting operation. For example, in hydraulic systems, the operating engine has a variable throttle that will be set by an operator, normally as dictated by the nature of the log being split.

Operation of a power source at a constant throttle is normally likewise inefficient. This is particularly true with the ram/wedge retracted and the overall system in standby mode awaiting introduction of an additional log piece to the bed.

The problem with fuel wasting has become even more significant given the increasingly high cost of such fuels. Additionally, unnecessary operation produces excessive emissions which are unfavorable to the environment and represent a health risk, notably to individuals working in the vicinity of the log splitter. This is particularly a problem in calm conditions where the products of combustion remain entrained in the air in the region around the log splitter.

In spite of the existence of the above problems, the industry has contended therewith because there have not been devised viable solutions thereto.

SUMMARY OF THE INVENTION

In one form of the invention, a log splitter is provided including a frame upon which a bed is defined for accepting a log to be split with the log in an operative position. The bed has an operating length between first and second components between which a log resides in the operative position. The first component is in the form of a wedge. The log splitter can be placed in: (a) a first operative state wherein the bed has a first operating length; and (b) a second operative state wherein the bed has a second operating length that is different than the first operating length. With the log splitter in the first operative state, at least one of the first and second components is movable: (a) from a first starting position towards the other of the first and second components in a first lengthwise direction to cause the wedge to be driven against a log in the operative position to effect splitting thereof; and (b) thereafter, away from the other of the first and second components in a second lengthwise direction oppositely to the first lengthwise direction back into the first starting position. With the log splitter in the second operative state, the one of the first and second components is movable: (a) from a second starting position, that is different than the first starting position, towards the other of the first and second components in the first lengthwise direction against a log in the operative position to effect splitting thereof; and (b) thereafter, away from the other of the first and second components in the second lengthwise direction back into the second starting position. The log splitter further has an operating assembly with a drive assembly through which the at least one of the first and second components is moved in the first and second lengthwise directions.

In one form, the drive assembly is configured to cause the one of the first and second components to consistently move after a splitting operation into: (a) the first starting position with the log splitter in the first operative state; and (b) the second starting position with the log splitter in the second operative state.

In one form, the log splitter further includes a blocking component with a blocking portion. The blocking component is movable selectively relative to the frame between first and second positions. The log splitter is in: (a) the first operative state with the blocking component in the first position; and (b) the second operative state with the blocking component in the second position. The blocking portion blocks movement of the one of the first and second components moving in the second lengthwise direction to thereby cause the one of the first and second components to consistently assume the first starting position with the blocking component in the first position therefore. The blocking portion blocks movement of the one of the first and second components moving in the second lengthwise direction to thereby cause the one of the first and second components to consistently assume the second starting position with the blocking component in the second position therefor.

In one form, the drive assembly is hydraulically operated.

In one form, the blocking component includes an elongate member that is guided for movement relative to the frame between the first and second positions and there is at least one element cooperating between the frame and elongate member that releasably maintains the elongate member selectively in each of the first and second positions therefor.

In one form, the one of the first and second components is movable: (a) from the first starting position lengthwise to a first fully extended position through a first length range with the log splitter in the first operative state; and (b) from the second starting position lengthwise to a second fully extended position through a second length range, different than the first length range, with the log splitter in the second operative state.

In one form, the drive assembly further includes a power source capable of being operated at different throttle settings. The power source is caused to operate at: a) a first throttle setting as an incident of the one of the first and second components moving in the first lengthwise direction to effect a splitting operation; and b) at a second, lower throttle setting as an incident of the one of the first and second components moving in the second lengthwise direction into each of the first and second starting positions.

In one form, the drive assembly includes an operating handle that is repositionable relative to the frame from a rest position into an actuating position to thereby cause the at least one of the first and second components to move from each of the first and second positions in the first lengthwise direction to effect a splitting operation.

In one form, the drive assembly includes a power source, a valve assembly and a cylinder with a rod that is: (a) extendable to move the at least one of the first and second components in the first lengthwise direction; and (b) retractable to move the at least one of the first and second components in the second lengthwise direction. The valve assembly has different states into which the valve assembly is placed through repositioning of the operating handle, thereby to cause the cylinder rod to be controllably extended and retracted.

In one form, the operating handle is normally biased towards the rest position.

In one form, the drive assembly includes power source, a valve assembly and a cylinder with a rod that is extendable to move the at least one of the first and second components in the first lengthwise direction and retractable to move the at least one of the first and second components in the second lengthwise direction. The operating assembly further includes a throttle control assembly. The throttle control assembly has: a) a slide plate that is movable relative to the frame between first and second positions; and b) a throttle changing lever that is movable relative to the frame between throttle up and throttle down positions. The throttle changing lever is urged with a biasing force towards the throttle up position. As an incident of the slide plate moving from its first position into its second position, the biasing force moves the throttle changing lever from the throttle down position into the throttle up position, thereby to increase a throttle setting for the power source.

In one form, the biasing force changes the blocking component from one of the first and second positions into a third position as an incident of the slide plate moving from its first position into its second position.

In one form, the operating assembly further includes a setting assembly for the blocking component. The setting assembly is operable to selectively, releasably maintain the blocking component in a plurality of different selected positions relative to the frame.

In one form, the setting assembly includes a first lever that is movable relative to the frame between first and second positions. The first lever is moved by the biasing force from its first position into its second position as an incident of the throttle changing lever moving from the throttle down position into the throttle up position and thereby causes the blocking component to be moved from the one of its first and second positions into the third position.

In one form, as an incident of the one of the first and second components moving towards and into one of the starting positions, the blocking component is caused to be moved from the third position into one of its first and second positions, in response to which the throttle changing lever is caused to be moved from the throttle up position into the throttle down position.

In one form, the first lever and throttle changing lever are guidingly movable relative to the frame around a common pivot axis.

In one form, the slide plate is moved from its first position into its second position as an incident of the operating handle moving from the rest position into the actuating position.

In one form, the setting assembly includes a spring-biased element and a plurality of spaced receptacles in the blocking component into which the spring-biased element is selectively directed.

In one form, the operating assembly further includes a pressure relief mechanism that causes the spring-biased element to be withdrawn from a receptacle in the blocking component into which the spring-loaded element is directed upon a predetermined force being applied to the blocking component caused by the one of the first and second component moving in the second lengthwise direction into one of the starting positions.

In one form, the power source has a first throttle lever that is repositioned to change a throttle level setting for the power source and there is a cable assembly that connects between the first throttle lever and the throttle changing lever that causes the first throttle lever to reposition in response to movement of the throttle changing lever.

DETAILED DESCRIPTION OF THE DRAWINGS

Figure 1:
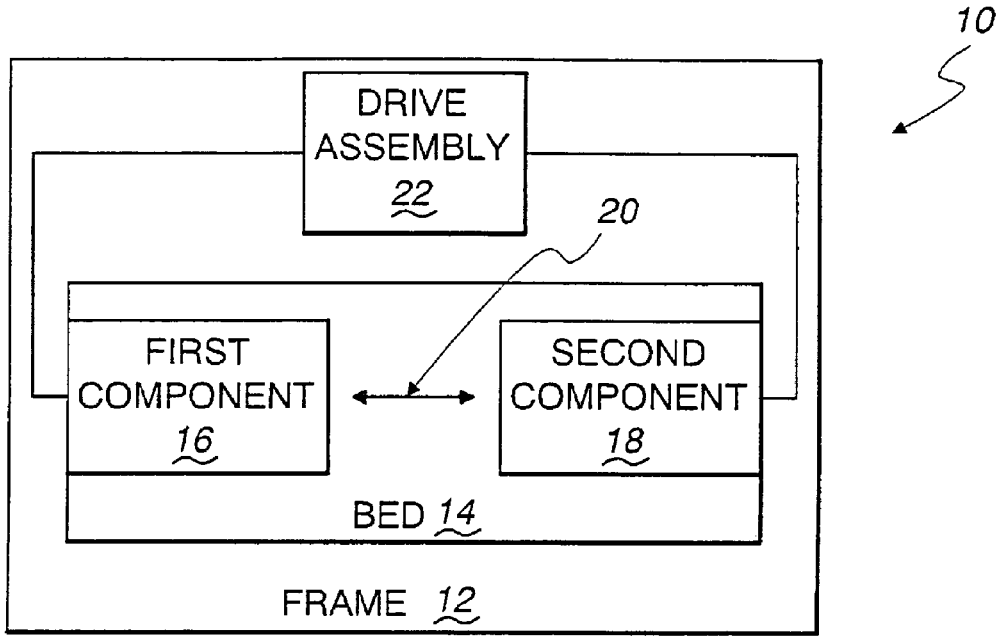
FIG. 1 is a schematic representation of a log splitter into which the present invention is incorporated.
Figure 3:
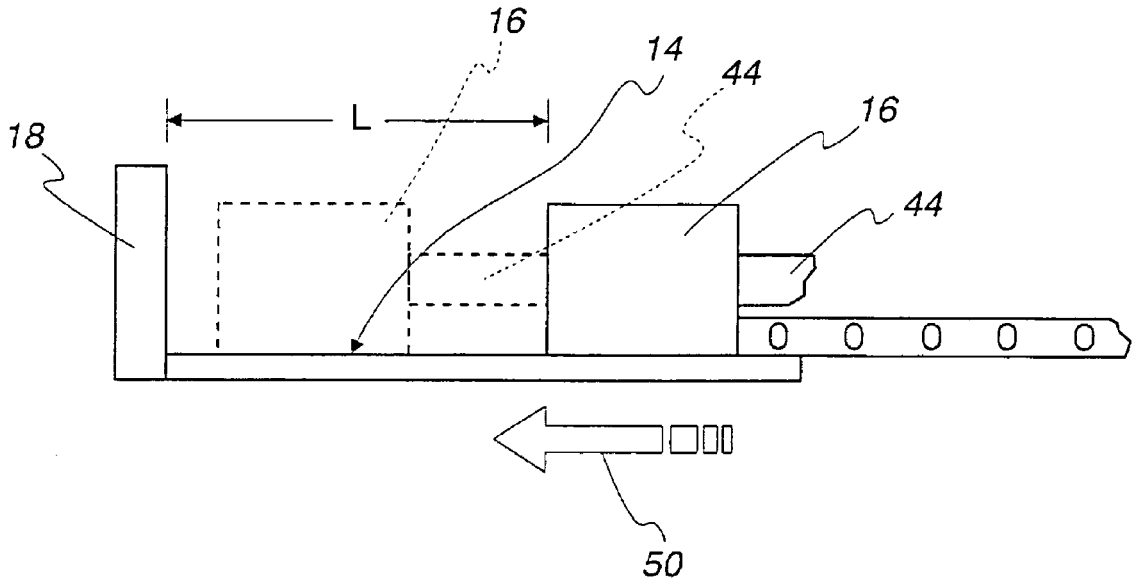
FIG. 3 is a partially schematic representation of a bed on the log splitter in FIG. 2 and showing a wedge and a cooperating component between which a log piece is split.

In FIG. 1, a log splitter is shown in schematic form at 10, to encompass numerous variations from the specific forms described hereinbelow. More specifically, the log splitter 10, to which the invention is directed, has a frame 12 with a bed 14 upon which a log piece to be split is placed in an operative position. The frame 12 supports first and second components 16, 18, respectively, between which a log piece in the operative position upon the bed 14 resides. Typically, the first component 16 will be a wedge against which a log piece in the operative position is forcibly driven to effect splitting thereof.

The first component 16 is movable towards and away from the second component 18 along a line indicated by the double-headed arrow 20. In the event that the wedge 16 is stationary, the second component 18 may function as a ram to move likewise along the line indicated by the arrow 20, thereby to drive the log piece in the operative position to against the wedge 16 for splitting of the log piece. The invention further contemplates that both of the first and second components 16,18 might be movable towards and away from each other to effect splitting of the log piece in the operative position upon the bed 14. The specific form, described below, utilizes a movable wedge 16. However, it should be understood that this form is exemplary in nature only.

The invention further contemplates that the log splitter 10, as depicted in FIG. 1, can have multiple different operating orientations. That is, the operating line indicated by the arrow 20 may be horizontal, as shown, or vertical, or may have any other angular orientation.

Further, the function performed by the second component 18 might be performed by a structure that is separate from the log splitter 10. For example, the log piece might be abutted to a separate piece of equipment, a stationary wall, the ground, etc.

Also, as shown in FIG. 1, it is contemplated that virtually any type of, drive assembly 22 may be incorporated to effect movement of the first and/or second components 16,18. The drive assembly 22 may be hydraulically operated. Alternatively, the drive assembly 22 may require an input from a user in a manner that exploits mechanical advantage.

Referring now to FIGS. 2-17, one specific form of the log splitter 10, according to the present invention, is depicted. The log splitter 10 has a wheel chassis 24 that is part of the frame 12 and facilitates transportation of the log splitter 10, as by towing using a conventional hitch assembly at 26. The hitch assembly 26 can be releasably connected to a towing vehicle (not shown).

An operating assembly 30 is mounted upon the frame 12 and is made up of a series of sub-assemblies, including the drive assembly 22 and additionally a setting assembly at 34, a throttle control assembly at 36, and a pressure relief assembly at 38.

The frame 12 includes a horizontal beam 40 which defines the bed 14 upon which a log piece 42 can be placed in the operative position for splitting.

In this embodiment, the first component 16 is in the form of a wedge, with the second component 18 in the form of a fixed wall extending upwardly from an end of the beam 40.

The wedge 16 is mounted upon a controllably extendable and retractable rod/ram 44 on a cylinder 46. The cylinder 46 is operative to selectively extend the rod 44 to thereby advance the wedge 16 from fully retracted/starting positions, shown in FIG. 2 and in solid lines in FIG. 3, to a fully extended position, shown in dotted lines in FIG. 3. The wedge 16 is movable through the cylinder 46 back and forth in a lengthwise path, as indicated by the double-headed arrow 48. More specifically, the wedge 16 is extended with the rod 44 to move from a retracted/starting position in a first lengthwise direction, as indicated by the arrow 50 in FIG. 3, and is retracted with the rod 44 by moving oppositely to the arrow 50 in a second lengthwise direction back into the starting/retracted position.

With the wedge 16 fully retracted, the bed 14 has an operating length L between the wedge 16 and second component 18 between which the log piece 42 resides in the operative position.

Figure 4:
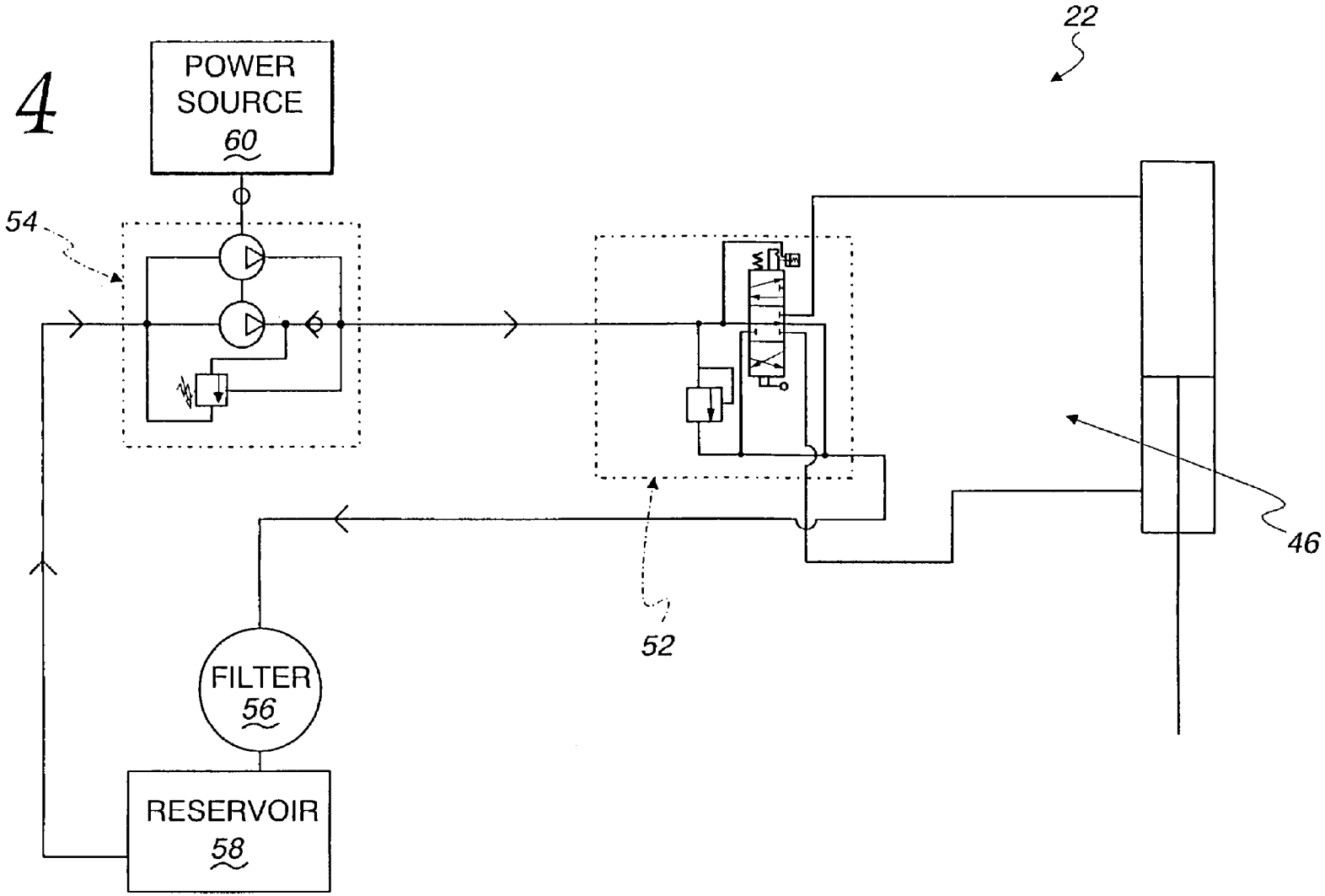
FIG. 4 is a schematic representation of a drive assembly for the log splitter in FIG. 2.

The drive assembly 22 is shown in schematic form in FIG. 4. Details of the drive assembly 22 are not critical to the present invention. It suffices to say that the drive assembly 22 consists of the cylinder 46, that is operated hydraulically through a circuit incorporating a valve 52 and a two-stage pump 54. Hydraulic fluid from the valve 52 is returned through a filter 56 to an hydraulic reservoir 58. The pump 54 is operable through a power source 60 that may be an electric motor, a gas-driven motor, or the like. In this embodiment, the power source 60 is gas powered.

Figure 2:
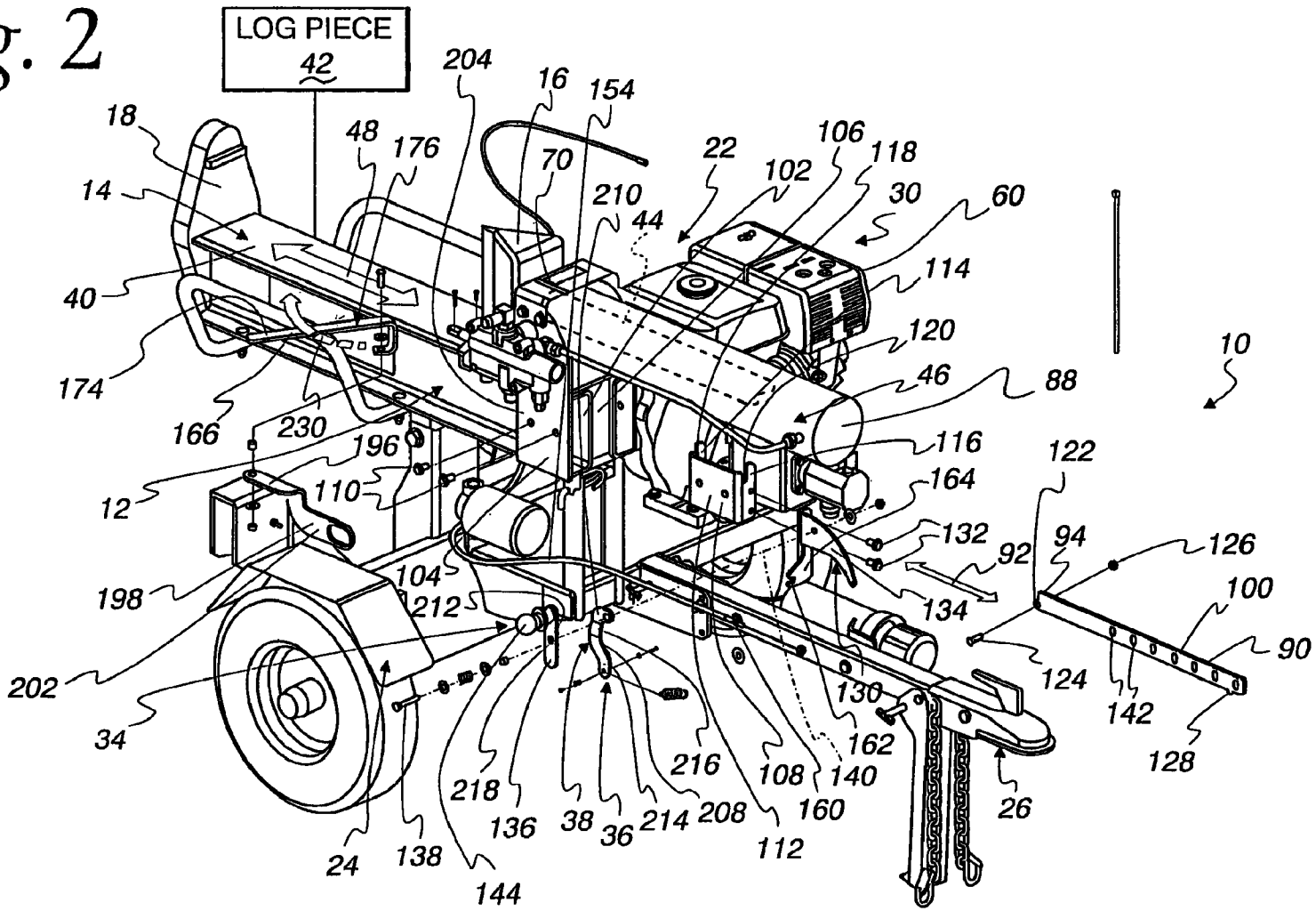
FIG. 2 is an exploded, perspective view of a specific form of the log splitter in FIG. 1.
Figure 5:
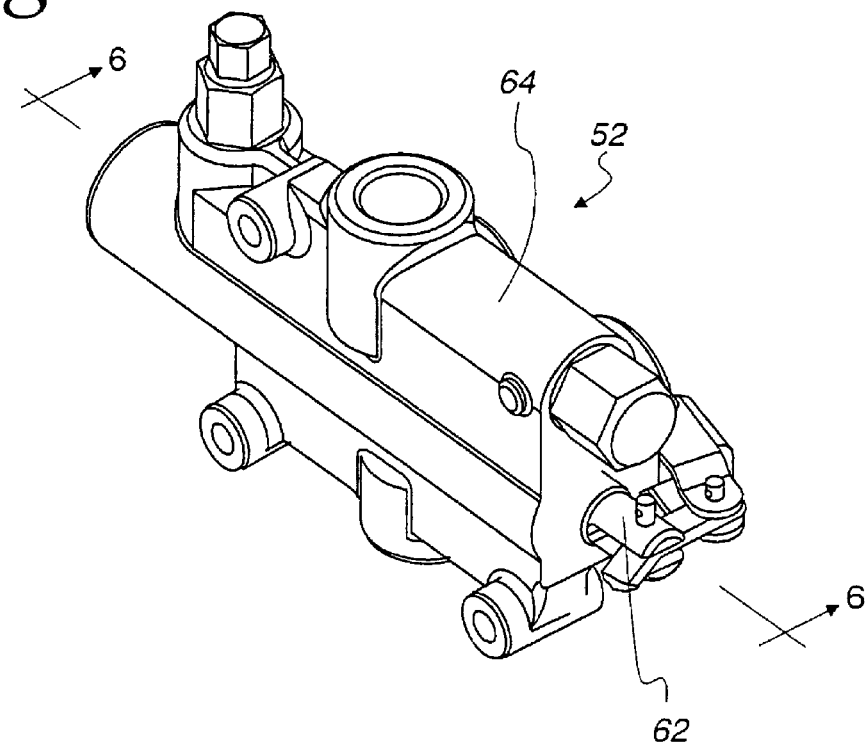
FIG. 5 is an enlarged, perspective view of a specific form of a valve on the drive assembly in FIG. 4.
Figure 6:
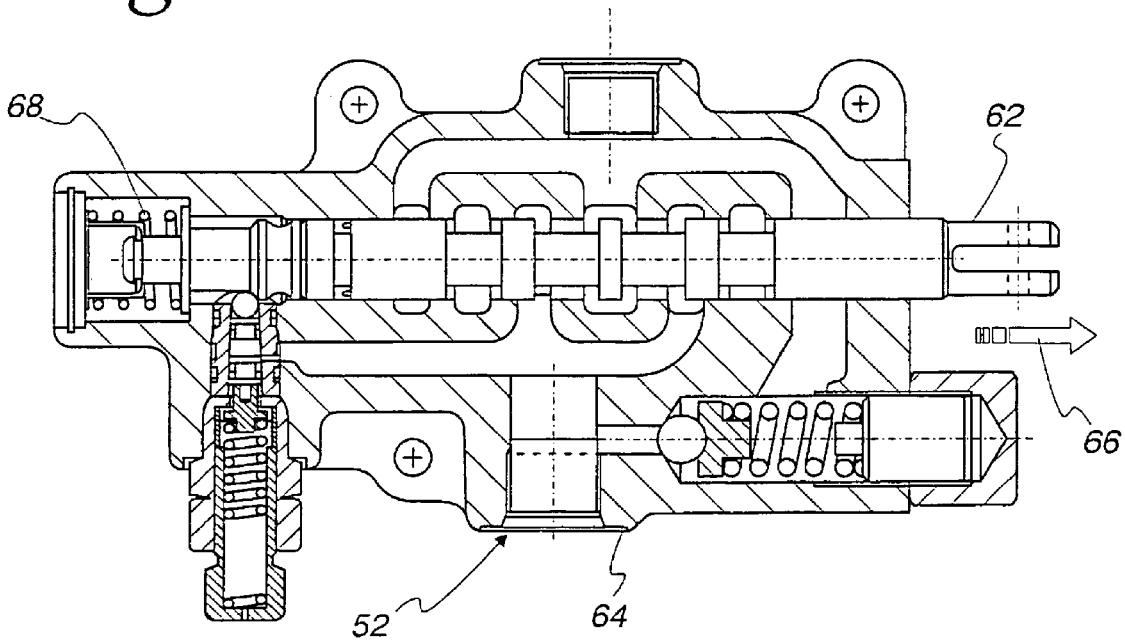
FIG. 6 is an inverted, cross-sectional view of the valve taken along line 6-6 of FIG. 5.

In FIG. 2, a gas powered engine 60 is used. One suitable valve 52 construction, as shown in detail in FIGS. 5 and 6, is manufactured by Prince as its Model LS-3000. This valve 52 is identified as a 3-position 4-way valve with a detent spool 62 that has a spring return to center feature. In the centered spool position, the wedge 16 is caused to be retracted to, and maintained in, its starting position.

To effect advancement of the wedge 16, the valve spool 62 is withdrawn from the valve housing 64, as indicated by the arrow 66 in FIG. 6. So long as the valve spool 62 is maintained in the withdrawn position, the wedge 16 will continue to advance in a lengthwise direction toward the second component 18.

The valve 52 will cause the wedge 16 to continue moving towards the second component/wall 18 until either the wedge 16 has advanced to full stroke for the cylinder 46 or a predetermined resistance is encountered, whereupon movement of the wedge 16 in the first lengthwise direction is halted. Release of the withdrawing force upon the valve spool 62 causes a spring 68, that is compressed during spool withdrawal, to extend and thereby draw the spool 62 back into the housing. The spring 68 normally biases the spool 62 into the FIG. 6 position. In this valve state, the wedge 16 is retracted towards, and ultimately maintained in, its starting position. By reason of incorporating a detent feature, the valve 52 will cause a pressure release as the wedge 16 retracts and abuts to a wall 70 on the frame 12.

The system can be designed so that the valve 52 must be manually maintained in different states to move the wedge 16 in both lengthwise directions. Alternatively, a structure might be incorporated so that the wedge 16 automatically retracts once the cylinder 46/wedge 16 moves through a full stroke or the wedge 16 encounters a predetermined resistance force. For safety purposes, it is preferred that the user be required to withdraw and maintain the valve spool 62 in a withdrawn position to continue advancement of the wedge 16 in the first lengthwise direction. This avoids a situation where a limb of an operator could be dangerously placed in the path of the wedge 16 without the user's being aware of the fact that the wedge 16 is advancing.

Figure 7:
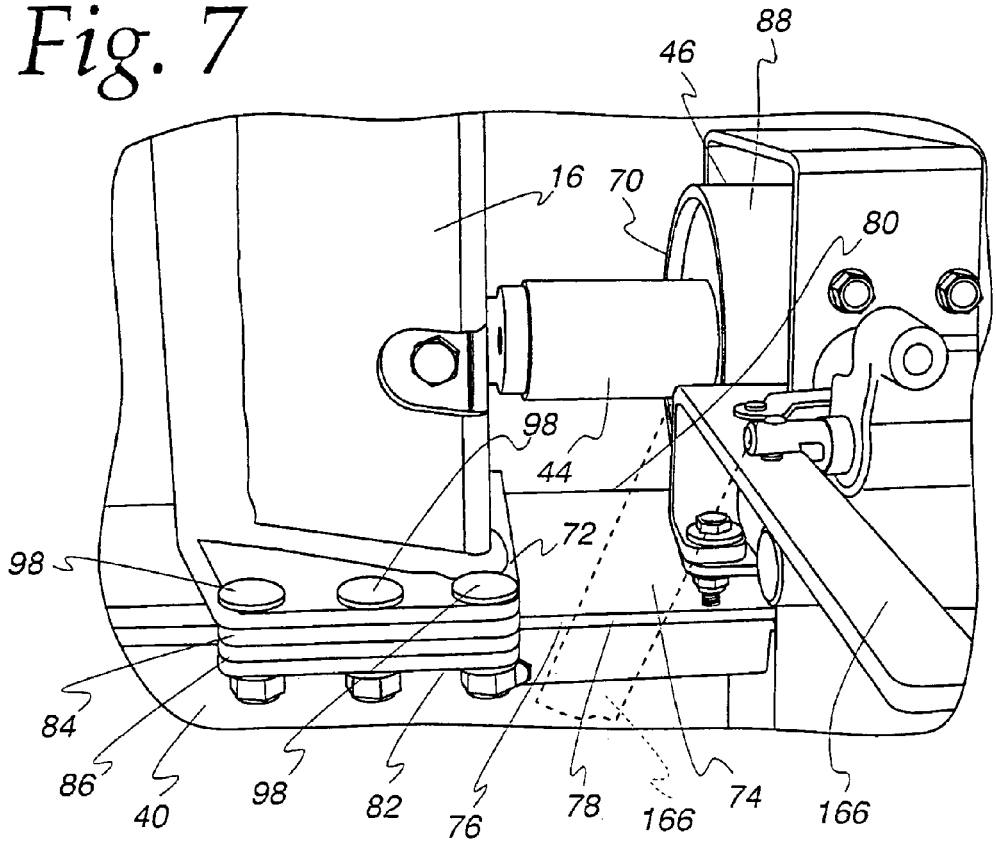
FIG. 7 is an enlarged, fragmentary, perspective view of the connection between the wedge and a frame on the log splitter in FIG. 2.
Figure 8:
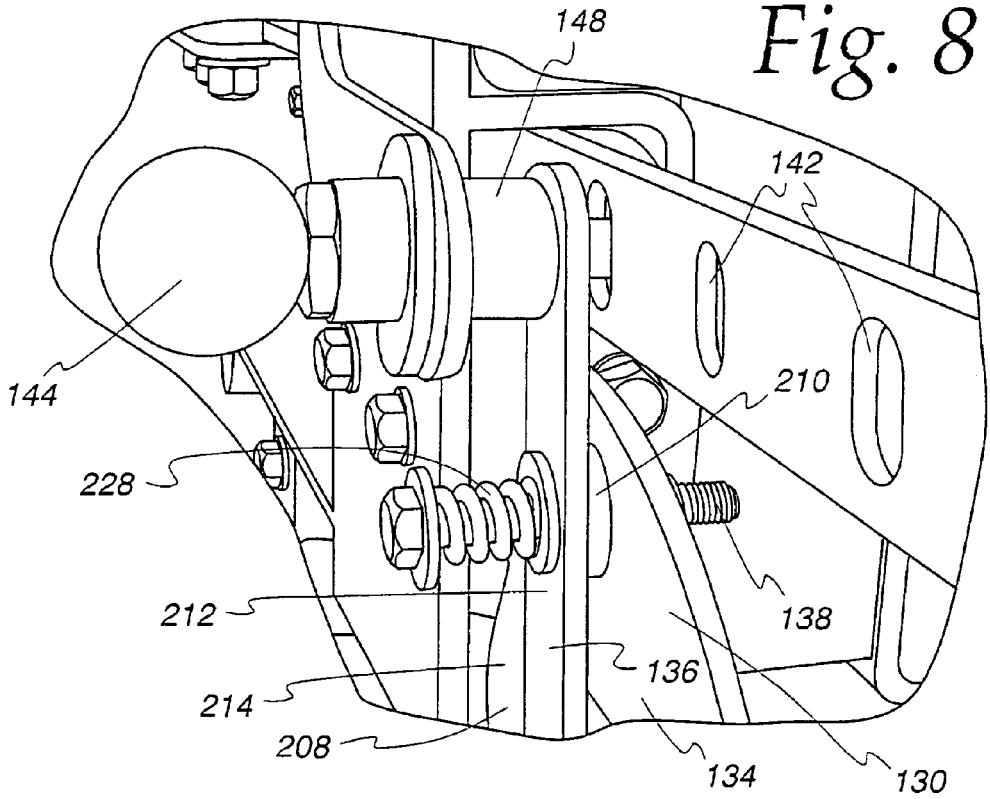
FIG. 8 is an enlarged, fragmentary, perspective view of a blocking component through which an operating length of the log splitter can be changed and showing setting, throttle control, and pressure relief assemblies that, in conjunction with the drive assembly in FIG. 4, make up an overall operating assembly for the log splitter.
Figure 17:
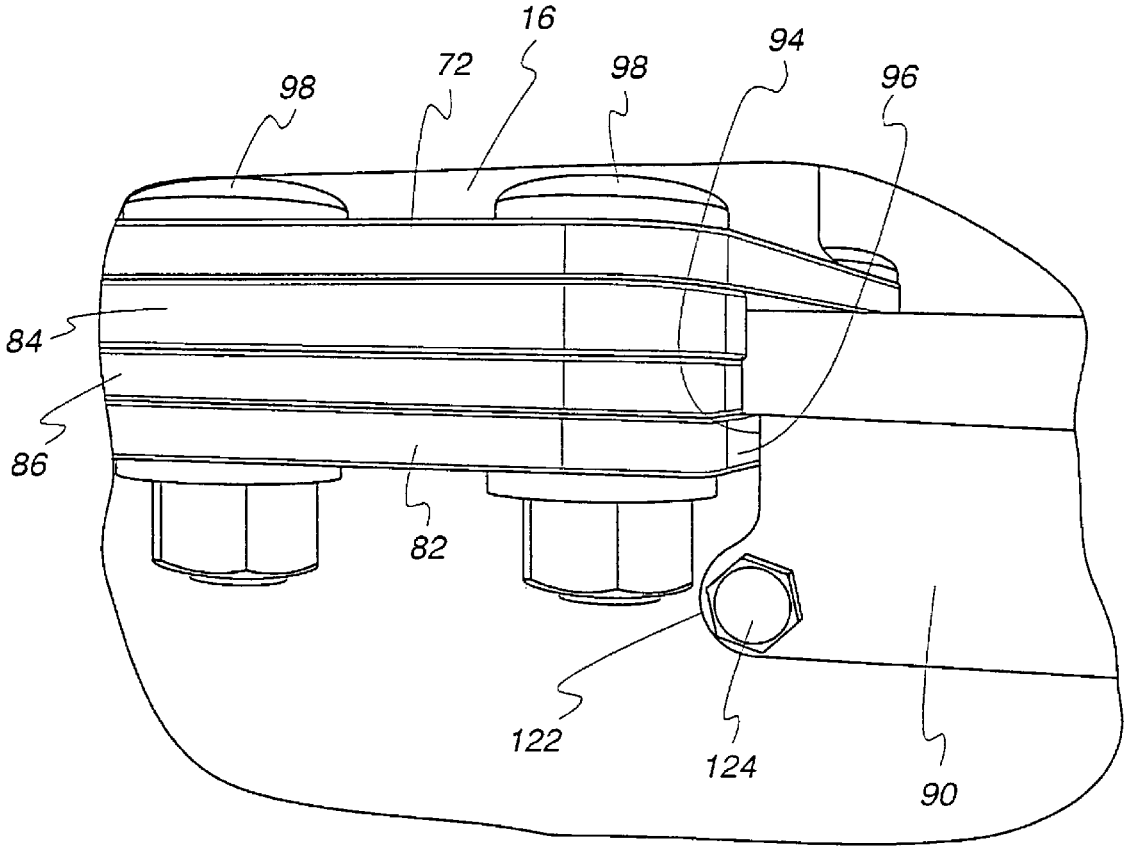
FIG. 17 is an enlarged, fragmentary, perspective view of parts of the wedge and blocking component that interact.

In this embodiment as seen most clearly in FIGS. 7 and 17, the wedge 16 has a bottom plate 72 fixedly attached thereto and placed against the top surface 74 of a flange 76 on the beam 40. The plate has a lateral dimension sufficient to overhang both edges 78,80 of the flange 76. Under the flange 76, a plate 82 is bolted to the plate 72 to produce a captive, sliding arrangement. Spacer plates 84,86, between the plates 72,82, maintain a vertical gap that allows the wedge 16 to be smoothly guided translatingly along the beam flange 76. A similar arrangement is provided at the opposite flange edge 80. This plate arrangement also laterally centers the wedge 16 in operation.

In this embodiment, the wedge 16 is retracted to the wall surface 70 that is actually a surface defined by an edge on a housing 88 for the cylinder 46. The housing 88 becomes an integral part of the frame 12 with this arrangement.

A blocking component 90 is mounted to the frame 12 for guided fore-and-aft/lengthwise movement relative thereto in the direction of the double-headed arrow 92 in FIG. 2. As seen most clearly in FIGS. 2 and 17, the blocking component 90 has a blocking portion 94 that is arranged to be placed in the path of a surface 96 on the plate 82 that is integrated to become part of the wedge 16 through bolts 98. By changing the fore-and-aft position of the blocking component 90, the lengthwise position at which the wedge 16 will contact the blocking portion 94 is selectively changed.

According to the invention, as described in greater detail below, the blocking component 90 is fixedly maintainable in different, selected lengthwise positions such that the wedge 16 will contact the blocking portion 94 and, through the hydraulic circuit arrangement, and particularly the detent component of the valve 52, be stopped in different lengthwise positions along the line of the arrows 48, 92. At the same time, once the wedge 16 is stopped, the valve construction causes there to be pressure relief in the circuit whereupon the wedge 16 is maintained in different positions, which become different starting positions for a splitting operation.

Accordingly, the operating length L of the bed 14 is variable by changing the lengthwise position of the blocking component 90. The length L can be strategically selected based upon an anticipated repeating length of the log pieces 42 to be split.

In this embodiment, the blocking component 90 has an elongate body 100 made from squared metal stock. The body 100 extends through a chamber 102 defined between spaced walls 104,106 on the frame 12.

In this embodiment, a guide channel 108 is located within the chamber 102 and secured to the wall 104 through fasteners 110. The guide channel 108 has a mounting wall 112 and guide walls 114,116 which are bent from the mounting wall 112 to be orthogonally disposed thereto. The walls 114,116 respectively have guide slots 118,120, matched nominally to the cross-sectional shape of the blocking component 90. The guide channel 108 guides the fore-and-aft movement of the blocking component 90 and also reinforces the blocking component 90 to limit deflection thereof in response to a retracting force imparted by the wedge 16.

The blocking component 90 is installed in a right-to-left direction in FIG. 2. With the leading end 122 exposed over the bed 14, a bolt 124 is directed therethrough and secured by a nut 126. The bolt 124 and nut 126 abut the wall 114 to prevent inadvertent left-to-right separation of the blocking component 90 from the frame 12 and guide channel 108, that becomes part of the frame 12.

A tab 128 at the end of the blocking component 90 opposite to the end 122, abuts to the wall 116 to limit right-to-left movement in FIG. 2, as potentially could otherwise permit inadvertent separation of the blocking component 90 from the frame 12.

An angle bracket 130 is fixed to the wall 116 through fasteners 132. One wall 134 of the bracket 130 serves as a support for a first lever 136, that defines the setting assembly 34. The lever 136 is mounted to the wall 134 through a pin 138 for guided movement around a laterally extending axis 140.

Figure 9:
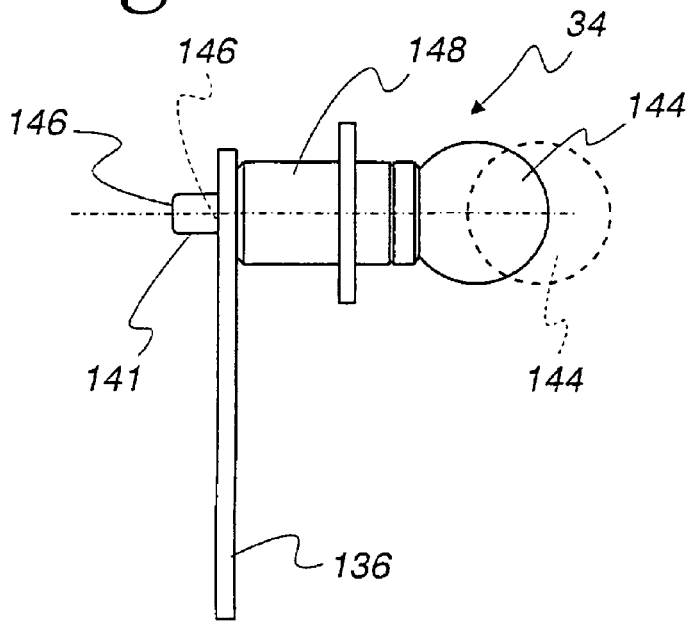
FIG. 9 is an enlarged, elevation view of the setting assembly for the log splitter.
Figure 10:
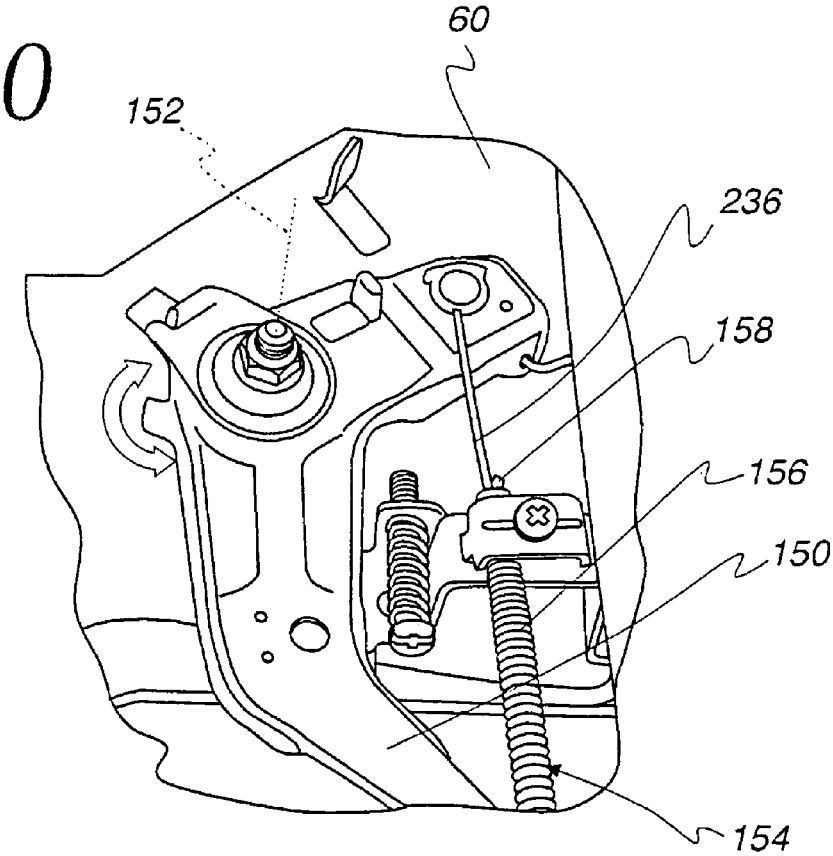
FIG. 10 is an enlarged, fragmentary, perspective view of a throttle lever for a power source on the log splitter and a cable assembly connected thereto.

The setting assembly 34 consists of an element 141 that is spring loaded to the solid position in FIG. 9 into an aligned aperture 142 on the blocking component 90. In this embodiment, seven such apertures 142 are provided to allow seven different fore-and-aft/lengthwise positions to be releasably set for the blocking component 90 relative to the frame 12, corresponding to seven different operating lengths L for the bed 14. The element 141 is movable through an enlarged, graspable knob 144, fixed thereto. A user can grasp the knob 144 and draw the element 141 from the solid line position into the dotted line position in FIG. 9. In the dotted line position, the end 146 of the element 141 resides outside of an aligned aperture 142 to allow the blocking component 90 to be slid freely in the fore-and-aft direction to allow changing of the operating length L, as desired. Spring biasing components (not shown) urge the element 141 into the solid line position in FIG. 9. These components reside within a cylindrical casing 148 and may take any of a multitude of different forms known to those skilled in the art.

In this embodiment, the apertures 142 are oval in shape, with elongation in a vertical direction. This avoids potential misalignment between the element 140 and apertures 142 that may be attributable to a number of different reasons, among which is a dimensional variation in components.

Accordingly, by simply withdrawing the element 141 through manipulation of the knob 144 against a biasing force, the end 146 can clear away from the aperture 142 to allow the user to slide the blocking component 90 to a desired position. By then releasing the knob 144, the element 141 is spring biased into the newly aligned aperture 142.

Another aspect of the invention is the ability to control the throttle on the power source 60 to select different throttle settings therefor. As seen in FIGS. 10-13, in this embodiment the power source 60 has a throttle lever 150 that is moved selectively around an axis 152 through a cable assembly 154 to change the throttle setting for the power source 60. The cable assembly 154 consists of a sheath 156 with ends 158, 160 anchored respectively at the power source 60 and within a receptacle 162 on a wall 164 on the bracket 130.

Figure 14:
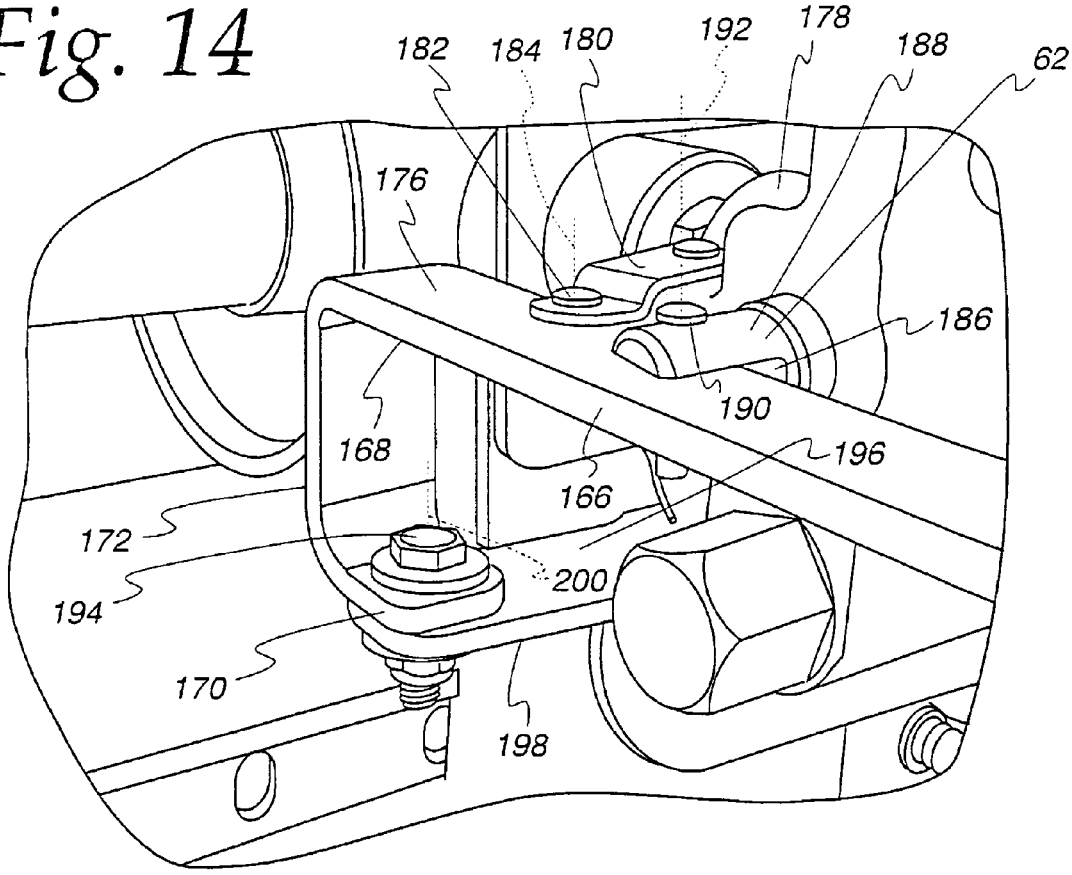
FIG. 14 is an enlarged, fragmentary, perspective view of an operating handle for the log splitter.
Figure 15:
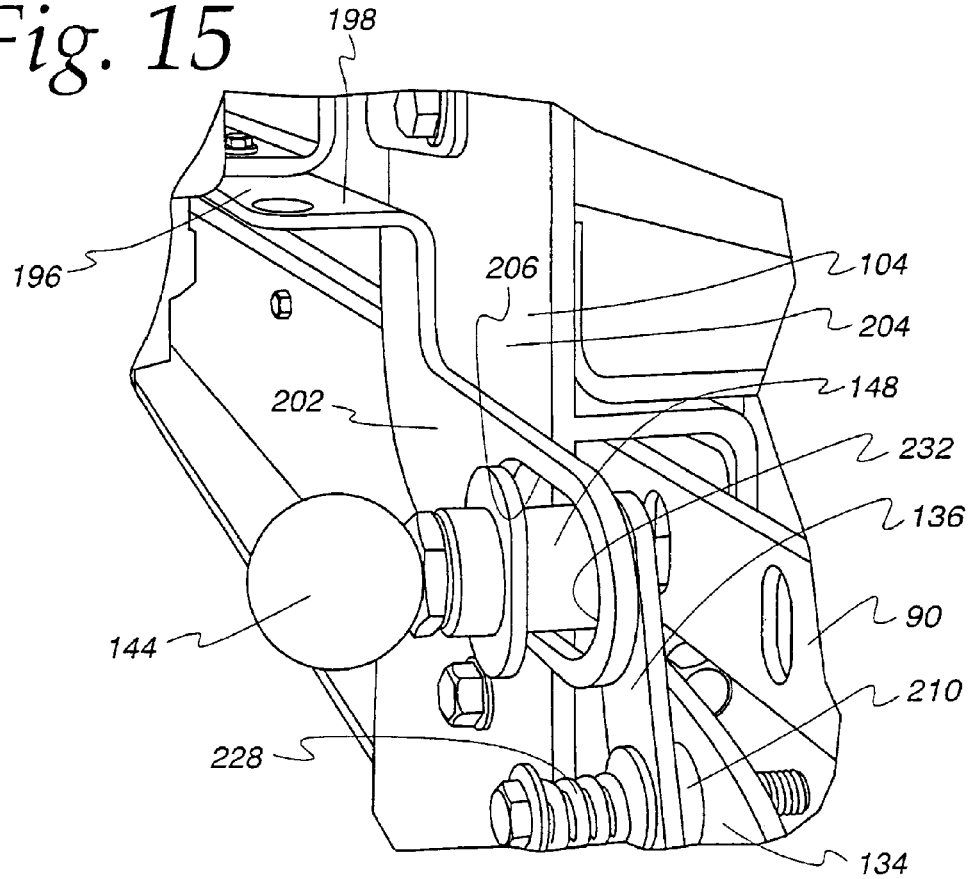
FIG. 15 is an enlarged, fragmentary, perspective view of the assemblies in FIG. 12 in the FIG. 12 state.
Figure 16:
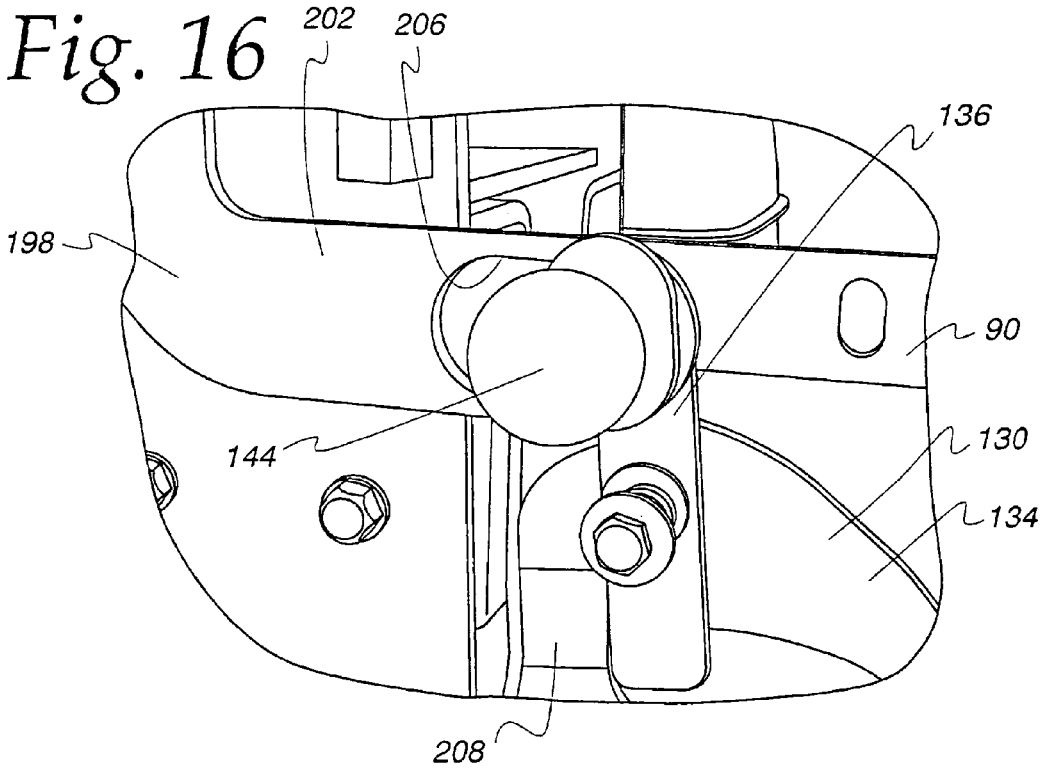
FIG. 16 is an enlarged, fragmentary, perspective view of the assemblies in the state in FIG. 11.

The operating assembly 30 includes an operating handle 166, as seen most clearly in FIGS. 2, 7 and 14, through which the valve spool 62 is repositioned. More specifically, the operating handle 166 has an overall "J" shape with long and short legs 168,170 joined by a bight portion 172.

The long leg 168 has a grasping portion 174 and a mounting portion 176. The mounting portion 176 is connected to a base 178 on the frame 12 through a mounting strap 180. A mounting pin 182 extends through the strap 180 and mounting portion 176 to guide movement of the handle 166 about a vertically extending axis 184 relative to the frame 12.

A portion of the long leg 168, in between the axis 184 and the mounting portion 176, extends into a receptacle 186 on a bifurcated end 188 on the valve spool 62. A pin 190 extends through the operating handle 166 and spool end 188 and guides the leg 168 for pivoting movement around an axis 192 that is parallel to the axis 184.

The short leg 170 is secured by a bolt/pin 194 for pivoting movement relative to a wall 196 on a slide plate 198 around a vertical axis 200.

The slide plate 198, as seen most clearly in FIGS. 2, 8 and 11-16, has a wall 202 that is transverse to the wall 196 and abuts, to slide facially against, a surface 204 on the frame wall 104. The wall 202 has an oval slot 206, elongated in a horizontal direction, in which the casing 148 is received.

A throttle changing lever 208 is mounted by the pin 138, that mounts the first lever 136, for common pivoting movement around the axis 140. The throttle changing lever 208 has a mounting tab 210 that resides between a wall 212 on the first lever 136 and the wall 134 on the angled bracket 130. The mounting tab 210 is part of an elongate plate 214 that is bent so that an edge 216 on a laterally offset/projecting portion 217 thereon is abuttable to a straight edge 218 on the wall 212 on the first lever 136.

A tension coil spring 220 is connected at the free end of the throttle changing lever 208 and at a free end 224 of the wall 134 on the angled bracket 130. The spring 220 normally urges the throttle changing lever 208 in the direction of the arrow 226 in FIG. 12 around the axis 140.

To allow the throttle changing lever 208 and first lever 136 to pivot freely around the axis 140, without binding, a coil spring 228 is installed to produce a bias force upon the first lever 136 that urges it against the throttle changing lever 208 and towards the wall 134 on the angle bracket 130. The characteristics of the springs 220,228 are selected so that the spring 220 will normally urge the components into the FIG. 12 state.

The valve spool 62 is urged normally by the spring 68 to a position wherein the operating handle 166 is in the rest position of FIGS. 7 and 14. The user's hand can surround the grasping portion 174 of the operating handle 166 and pivot it in the direction of the arrow 230 in FIG. 2 around the axis 184 into an actuating position, shown in dotted lines in FIG. 7. As this occurs, the short leg 170 on the operating handle 166 causes the slide plate 198 to shift from a first position, shown in FIGS. 11 and 16, to a second position, shown in FIGS. 12 and 13. In the first slide plate position, the casing 148 resides at one end 232 of the slot 206.

Figure 11:
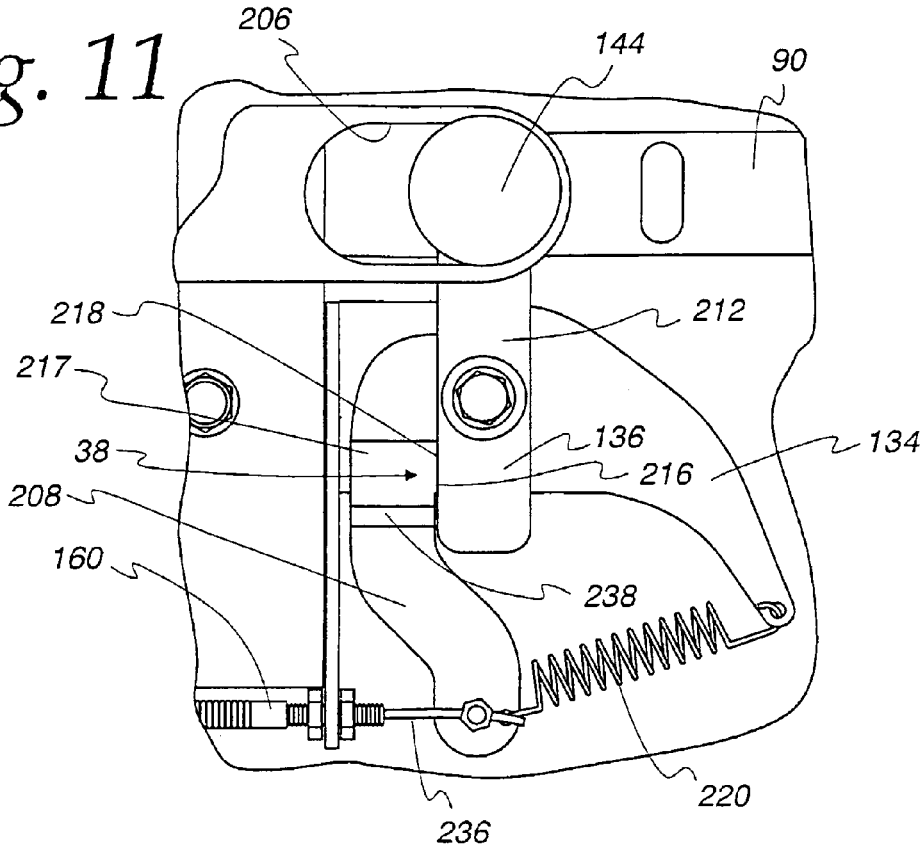
FIG. 11 is an enlarged, fragmentary, elevation view of the setting, throttle control, and pressure relief assemblies on the log splitter with the power source at a low/idle throttle setting.
Figure 12:
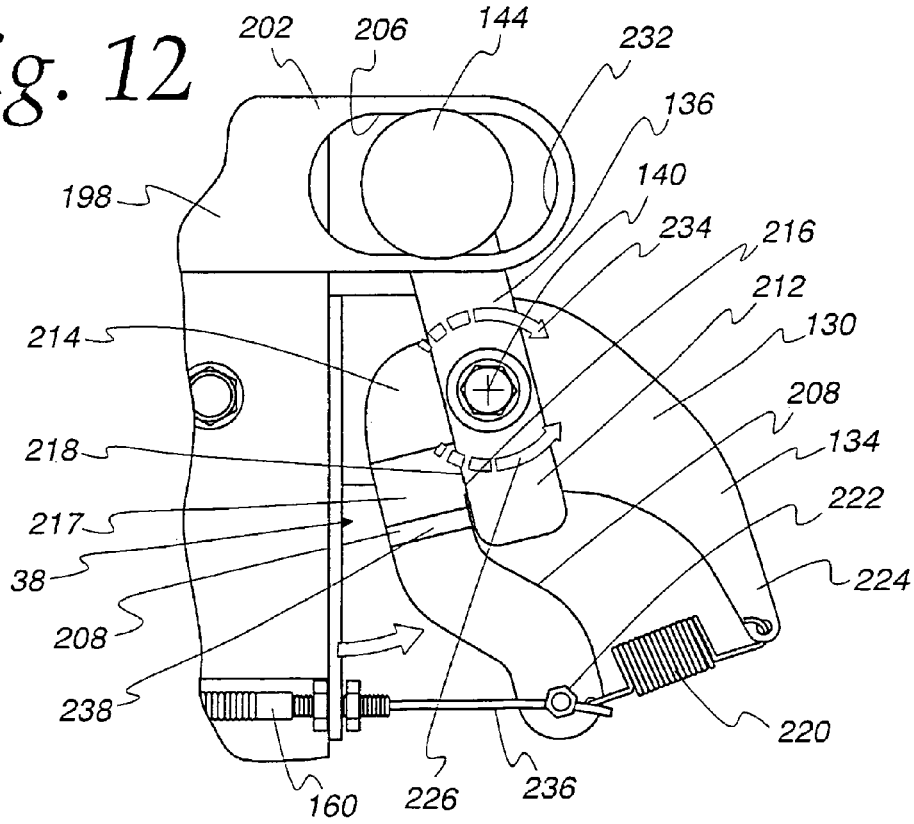
FIG. 12 is a view as in FIG. 11 wherein the power source is at a higher throttle setting.
Figure 13:
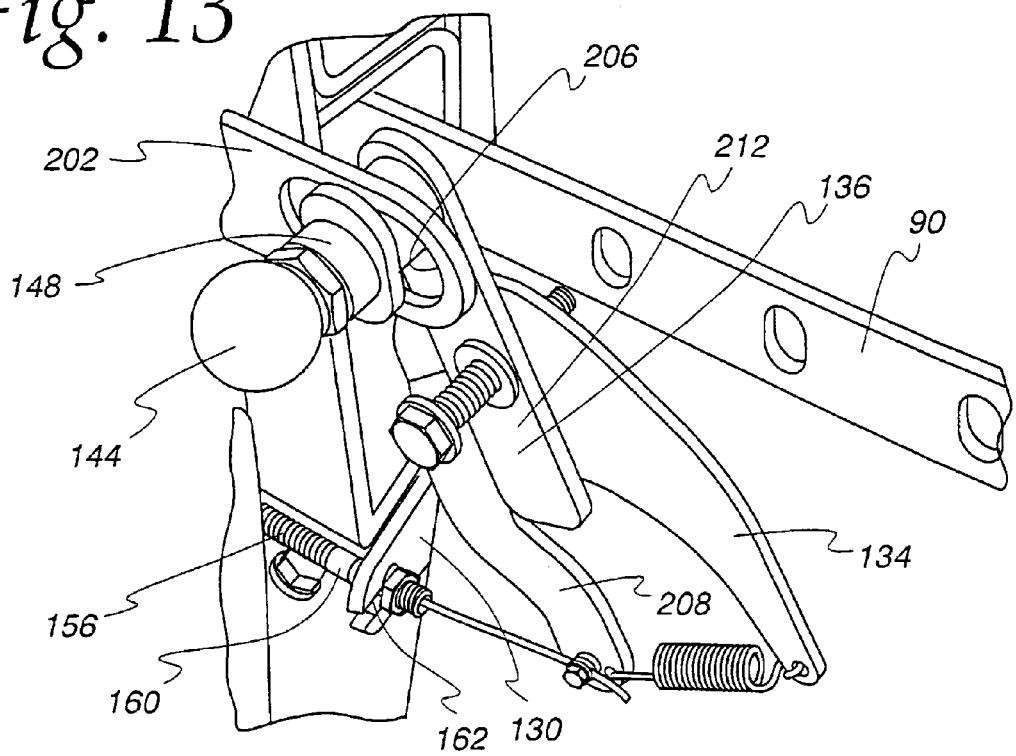
FIG. 13 is an enlarged, perspective view of the assemblies as shown in the FIG. 12 state.

As the operating handle 166 is moved from the actuating position into the rest position, the wedge 16 is retracted and, through the interaction of the blocking component 90 and element 141, urges the first lever 136 in the direction of the arrow 234 in FIG. 12 around the axis 140. This causes the edge 218 on the first lever 136 to bear against the edge 216 on the throttle changing lever 208, thereby urging both components to the FIG. 11 position, thereby loading the spring 220 in tension.

In the FIG. 11 state, a core 236 on the cable assembly 154 is shifted to an idle/lower throttle setting. The throttle changing lever 208 in FIG. 11 is in a throttle down position.

By moving the operating handle 166 from the rest position into the actuating position, the wedge 16 is advanced from its starting position and the slide plate 198 is shifted from its first position in FIG. 11 into its second position in FIG. 12. The loaded spring 220 pivots the throttle changing lever 208 to a throttle up position in FIG. 12. The throttle changing lever 208 acts against the first lever 136, thereby changing it from a first position in FIG. 11, to a second position in FIG. 12. This pivoting movement of the first lever 136 causes the element 141 to shift the blocking component 90 slightly forwardly to another position relative to the frame 12, which is permitted since the wedge 16 is advanced at this point. By reason of the elongation of the slot 206, the casing 148 can shift therewithin to accommodate repositioning of the first lever 136.

As the levers 136,208 change from the FIG. 11 position into the FIG. 12 position, the cable core 236 is shifted to pivot the throttle lever thereby to increase the throttle setting for the power source 60 to the desired operating level.

At the completion of a splitting operation, the user releases the operating handle 166 so that it is allowed to change from the actuating position back into the rest position. The wedge 16 is thus retracted and eventually biased against the blocking portion 94 of the blocking component 90 to shift the blocking component 90 to cause the first lever 136 to pivot the throttle changing lever 208 from the FIG. 12 position back into the FIG. 11 position, whereupon the cable core 236 is shifted to cause the power source 60 to go back to the idle setting.

It can thus be seen that by re-setting the blocking component 90, the log splitter 10 can be placed in multiple different states, corresponding in number to the usable apertures 142. Each state is responsible for a different operating length 14 and accounts for a different starting position for the wedge 16. Further, between a starting position and a corresponding fully extended position, the wedge 16 is caused to extend through different length ranges.

As previously noted, the log splitter 10 incorporates the pressure relief assembly 38. Essentially, as seen in FIGS. 11 and 12, the structure consists of a ramp portion 238 on the throttle changing lever 208 that cooperates with the edge 218 on the first lever 136. In the event that a user continues to apply a force on the operating handle 166 towards the rest position, once the operating handle 166 has realized the rest position, an increased retracting force will be applied that might have a tendency to damage system components. To avoid this, the edge 218 will be urged against the ramp portion 238 with a sufficient force that the first lever 136 will be shifted laterally outwardly against the force of the spring 228, eventually to the point that the element 141 retracts from the aligned aperture 142, whereupon the blocking component 90 is allowed to shift from left to right in FIG. 2 to release excessive pressure buildup on the components.

The invention contemplates that the inventive features might be built into the log splitter 10 by the manufacturer. Alternatively, the inventive features can be incorporated through a retrofit kit, whereupon a conventionally constructed log splitter can be modified to select operating length and to strategically control the throttle of the power source so that the throttle will be lowered with the wedge 16 retracted and increased as the wedge 16 is extended and during the performance of a log splitting operating.

The foregoing disclosure of specific embodiments is intended to be illustrative of the broad concepts comprehended by the invention.

The invention claimed is:

1. A log splitter comprising:

a frame;

a bed defined on the frame for accepting a log to be split with the log in an operative position, the bed having an operating length between first and second components between which a log resides in the operative position, the first component comprising a wedge, the log splitter having: (a) a first operative state wherein the bed has a first operating length; and (b) a second operative state wherein the bed has a second operating length that is different than the first operating length, with the log splitter in the first operative state, at least one of the first and second components is movable: (a) from a first starting position towards the other of the first and second components in a first lengthwise direction to cause the wedge to be driven against a log in the operative position to effect splitting thereof; and (b) thereafter, away from the other of the first and second components in a second lengthwise direction oppositely to the first lengthwise direction back into the first starting position, with the log splitter in the second operative state, the one of the first and second components is movable: (a) from a second starting position, that is different than the first starting position, towards the other of the first and second components in the first lengthwise direction against a log in the operative position to effect splitting thereof; and (b) thereafter, away from the other of the first and second components in the second lengthwise direction back into the second starting position;

a blocking component on the frame having a blocking portion capable of being fixed in at least first and second different positions relative to the frame; and an operating assembly comprising a drive assembly through which the at least one of the first and second components is moved in the first and second lengthwise directions, wherein the blocking component is: a) in its first position relative to the frame with the log splitter in the first operative state; and b) in its second position relative to the frame with the log splitter in the second operative state, the blocking portion fixed in the first position and engaging the one of the first and second components as the one of the first and second components moves up to and against the blocking portion to block movement of the one of the first and second components in the second lengthwise direction consistently in the first starting position with the blocking portion remaining fixed in the first position and the log splitter in the first operative state, the blocking portion fixed in the second position and engaging the one of the first and second components as the one of the first and second components moves up to and against the blocking portion to block movement of the one of the first and second components in the second lengthwise direction consistently in the second starting position with the blocking portion remaining fixed in the second position and the log splitter in the second operative state.

2. The log splitter according to claim 1 wherein the drive assembly is hydraulically operated.

3. The log splitter according to claim 1 wherein the one of the first and second components is movable: (a) from the first starting position lengthwise to a first fully extended position through a first length range with the log splitter in the first operative state; and (b) from the second starting position lengthwise to a second fully extended position through a second length range, different than the first length range, with the log splitter in the second operative state.

4. The log splitter according to claim 2 wherein the drive assembly comprises an operating handle that is repositionable relative to the frame from a rest position into an actuating position to thereby cause the at least one of the first and second components to move from each of the first and second positions in the first lengthwise direction to effect a splitting operation.

5. The log splitter according to claim 4 wherein the drive assembly comprises a power source, a valve assembly and a cylinder with a rod that is extendable to move the at least one of the first and second components in the first lengthwise direction and retractable to move the at least one of the first and second components in the second lengthwise direction, the valve assembly having different states into which the valve assembly is placed through repositioning of the operating handle thereby to cause the cylinder rod to be controllably extended and retracted.

6. The log splitter according to claim 5 wherein the operating handle is normally biased towards the rest position.

7. The log splitter according to claim 1 wherein the drive assembly comprises a power source, a valve assembly and a cylinder with a rod that is extendable to move the at least one of the first and second components in the first lengthwise direction and retractable to move the at least one of the first and second components in the second lengthwise direction.

8. The log splitter according to claim 7 wherein the blocking element is not on the cylinder.

9. The log splitter according to claim 7 wherein the blocking component remains fixed relative to the frame in one of the first and second different positions as the cylinder rod is extended and retracted.

10. A log splitter comprising:

a frame;

a bed defined on the frame for accepting a log to be split with the log in an operative position, the bed having an operating length between first and second components between which a log resides in the operative position, the first component comprising a wedge, the log splitter having: (a) a first operative state wherein the bed has a first operating length; and (b) a second operative state wherein the bed has a second operating length that is different than the first operating length, with the log splitter in the first operative state, at least one of the first and second components is movable: (a) from a first starting position towards the other of the first and second components in a first lengthwise direction to cause the wedge to be driven against a log in the operative position to effect splitting thereof; and (b) thereafter, away from the other of the first and second components in a second lengthwise direction oppositely to the first lengthwise direction back into the first starting position, with the log splitter in the second operative state, the one of the first and second components is movable: (a) from a second starting position, that is different than the first starting position, towards the other of the first and second components in the first lengthwise direction against a log in the operative position to effect splitting thereof; and (b) thereafter, away from the other of the first and second components in the second lengthwise direction back into the second starting position; and an operating assembly comprising a drive assembly through which the at least one of the first and second components is moved in the first and second lengthwise directions, wherein the drive assembly is configured to cause the one of the first and second components to consistently move after a splitting operation into: (a) the first starting position with the log splitter in the first operative state; and b) the second starting position with the log splitter in the second operative state, wherein the log splitter further comprises a blocking component with a blocking portion, the blocking component movable selectively relative to the frame between first and second positions, the log splitter in: (a) the first operative state with the blocking component in the first position; and (b) the second operative state with the blocking component in the second position, the blocking portion blocking movement of the one of the first and second components moving in the second lengthwise direction to thereby cause the one of the first and second components to consistently assume the first starting position with the blocking component in the first position therefor, the blocking portion blocking movement of the one of the first and second components moving in the second lengthwise direction to thereby cause the one of the first and second components to consistently assume the second starting position with the blocking component in the second position therefor, wherein the drive assembly comprises a power source, a valve assembly and a cylinder with a rod that is extendable to move the at least one of the first and second components in the first lengthwise direction and retractable to move the at least one of the first and second components in the second lengthwise direction, the operating assembly further comprising a throttle control assembly, the throttle control assembly comprising: a) a slide plate that is movable relative to the frame between first and second positions; and b) a throttle changing lever that is movable relative to the frame between throttle up and throttle down positions, the throttle changing lever urged with a biasing force towards the throttle up position, and as an incident of the slide plate moving from its first position into its second position the biasing force moves the throttle changing lever from the throttle down position into the throttle up position thereby to increase a throttle setting for the power source.

11. The log splitter according to claim 10 wherein the blocking component comprises an elongate member that is guided for movement relative to the frame between the first and second positions and there is at least one element cooperating between the frame and elongate member that releasably fixedly maintains the elongate member selectively in each of the first and second positions therefor.

12. The log splitter according to claim 10 wherein the biasing force changes the blocking component from one of the first and second positions into a third position as an incident of the slide plate moving from its first position into its second position.

13. The log splitter according to claim 12 wherein the operating assembly further comprises a setting assembly for the blocking component, the setting assembly operable to selectively, releasably maintain the blocking component in a plurality of different selected positions relative to the frame.

14. The log splitter according to claim 13 wherein the setting assembly comprises a first lever that is movable relative to the frame between first and second positions, the first lever moved by the biasing force from its first position into its second position as an incident of the throttle changing lever moving from the throttle down position into the throttle up position and thereby causes the blocking component to be moved from the one of its first and second positions into the third position.

15. The log splitter according to claim 14 wherein as an incident of the one of the first and second components moving towards and into one of the starting positions, the blocking component is caused to be moved from the third position into one of its first and second positions, in response to which the throttle changing lever is caused to be moved from the throttle up position into the throttle down position.

16. The log splitter according to claim 15 wherein the first lever and throttle changing lever are guidingly movable relative to the frame around a common pivot axis.

17. The log splitter according to claim 15 wherein the slide plate is moved from its first position into its second position as an incident of the operating handle moving from the rest position into the actuating position.

18. The log splitter according to claim 13 wherein the setting assembly comprises a spring-biased element and a plurality of spaced receptacles in the blocking component into which the spring-biased element is selectively directed.

19. The log splitter according to claim 18 wherein the operating assembly further comprises a pressure relief mechanism that causes the spring-biased element to be withdrawn from a receptacle in the blocking component into which the spring-loaded element is directed upon a predetermined force being applied to the blocking component caused by the one of the first and second component moving in the second lengthwise direction into one of the starting positions.

20. The log splitter according to claim 14 wherein the power source has a first throttle lever that is repositioned to change a throttle level setting for the power source and there is a cable assembly that connects between the first throttle lever and the throttle changing lever that causes the first throttle lever to reposition in response to movement of the throttle changing lever.

21. A log splitter comprising:

a frame;

a bed defined on the frame for accepting a log to be split with the log in an operative position, the bed having an operating length between first and second components between which a log resides in the operative position, the first component comprising a wedge, the log splitter having: (a) a first operative state wherein the bed has a first operating length; and (b) a second operative state wherein the bed has a second operating length that is different than the first operating length, with the log splitter in the first operative state, at least one of the first and second components is movable: (a) from a first starting position towards the other of the first and second components in a first lengthwise direction to cause the wedge to be driven against a log in the operative position to effect splitting thereof; and (b) thereafter, away from the other of the first and second components in a second lengthwise direction oppositely to the first lengthwise direction back into the first starting position, with the log splitter in the second operative state, the one of the first and second components is movable: (a) from a second starting position, that is different than the first starting position, towards the other of the first and second components in the first lengthwise direction against a log in the operative position to effect splitting thereof; and (b) thereafter, away from the other of the first and second components in the second lengthwise direction back into the second starting position; and an operating assembly comprising a drive assembly through which the at least one of the first and second components is moved in the first and second lengthwise directions, wherein the drive assembly further comprises a power source capable of being operated at different throttle settings and the power source is caused to operate at: a) a first throttle setting as an incident of the one of the first and second components moving in the first lengthwise direction to effect a splitting operation; and b) at a second, lower throttle setting as an incident of the one of the first and second components moving in the second lengthwise direction into each of the first and second starting positions.

* * * * *